US006648431B1

(12) United States Patent
King

(10) Patent No.: US 6,648,431 B1
(45) Date of Patent: Nov. 18, 2003

(54) CABINET HINGE ATTACHMENT SYSTEM

(76) Inventor: Ron E. King, 1545 River Park Dr., Suite 450, Sacramento, CA (US) 95815

( * ) Notice: Subject to any disclaimer, the term of this patent is extended or adjusted under 35 U.S.C. 154(b) by 0 days.

(21) Appl. No.: 10/006,675

(22) Filed: Nov. 5, 2001

(51) Int. Cl.[7] ..... A47B 49/00; E05D 5/00
(52) U.S. Cl. ..... 312/326; 16/382
(58) Field of Search ..... 312/326, 327, 312/328, 329, 138.1; 16/382, 221, 236, 383, 384

(56) References Cited

U.S. PATENT DOCUMENTS 4,319,382 A * 3/1982 Zernig ..... 16/251
4,691,408 A * 9/1987 Rock et al. ..... 16/241
5,054,164 A * 10/1991 Blanco-Equiluz ..... 16/258
5,103,532 A * 4/1992 Youngdale et al. ..... 16/288
5,966,779 A * 10/1999 Salice ..... 16/383 X
6,418,589 B1 * 7/2002 Salice ..... 16/382 X

FOREIGN PATENT DOCUMENTS

DE 2149503 * 4/1973 ..... 16/382
JP 40-3-284222 * 12/1991 ..... 312/326

* cited by examiner

*Primary Examiner*—James O. Hansen
(74) *Attorney, Agent, or Firm*—Thomas R. Lampe

(57) ABSTRACT

A cabinet door hinge is attached to a cabinet wall by a hinge which includes an elongated hinge mounting plate. The mounting plate extends between two vertical rows of holes formed in the cabinet wall and dowels or other fasteners connected to the mounting plate enter holes in both rows to provide attachment and prevent pivotal movement of said elongated hinge mounting plate relative to said cabinet wall.

1 Claim, 2 Drawing Sheets

CABINET HINGE ATTACHMENT SYSTEM

TECHNICAL FIELD

This invention relates to a fastening system for connecting a door support hinge to a cabinet wall. The invention has particular application for use with thin walled cabinets, i.e., cabinets having walls of no more than a half inch thickness at the location of hinge connection thereto.

BACKGROUND OF THE INVENTION

For quite some time now, since at least the 1970's, a system, called the 32 millimeter system, has been utilized in cabinet constructions. In the system holes are formed in cabinet walls which extend inwardly into the walls from the interior wall surfaces thereof. The holes are arrayed in spaced vertical rows which are 32 millimeters apart, center to center.

The reason for this precise placement is to facilitate installation of hardware such as mounting plates, drawer slides and the like by machinery. Fasteners associated with these parts are automatically located by the machines at the desired hole locations and installation completed. Essentially the machines are programmed with mathematical equations based on the 32 millimeter system to accomplish installation of the hardware with very little or in some cases even no labor being involved. Typically, 10 millimeter knock-in retention dowels are the fasteners employed.

It is conventional practice to install mounting plates of the 32 millimeter system with the mounting plates oriented vertically so that the dowel or dowels employed as fasteners are disposed in adjacent holes of only a single row. Unfortunately, this approach readily leads to structural failure of the cabinet wall when a force is applied to the cabinet door hinged to the mounting plates when the cabinet wall is thin, i.e., one half inch or less in thickness.

DISCLOSURE OF INVENTION

The present invention relates to structure which enables hinge mounting plates to be securely fastened in the holes of cabinets utilizing the 32 millimeter system, despite the fact that the cabinet is thin walled, i.e. one half inch in thickness or less. Utilizing the arrangement of the present invention, the cabinet wall may be subjected to relatively high loads caused by downward forces being exerted on the cabinet door without causing failure.

The combination of the invention includes a cabinet wall including an interior wall surface and having a plurality of holes formed therein extending inwardly into the cabinet wall from the interior wall surface. The holes are arrayed in a plurality of parallel, vertical rows, each vertical row separated a predetermined distance from adjacent vertical rows. The holes of each vertical row are spaced from one another.

A first hinge member is employed for attachment to a cabinet door.

A second hinge member is hingedly connected to the first hinge member. The second hinge member includes an elongated mounting plate having a cabinet wall engagement surface.

A plurality of fasteners are connected to the elongated mounting plate and extend from the cabinet wall engagement surface.

The elongated mounting plate extends horizontally between two adjacent vertical rows of holes formed in the cabinet wall with at least one of the fasteners located in a hole of one of said two adjacent vertical rows and at least one of the fasteners located in a hole of the other of said two adjacent vertical rows.

The fasteners are cooperable with the cabinet wall to resist pivoting of the second hinge member relative to the cabinet wall and failure of the cabinet wall at the hinge location when a downwardly directed force is applied to the first hinge member.

Other features, advantages and objects of the present invention will become apparent with reference to the following description and accompanying drawings.

MODES FOR CARRYING OUT THE INVENTION

Figure 1:
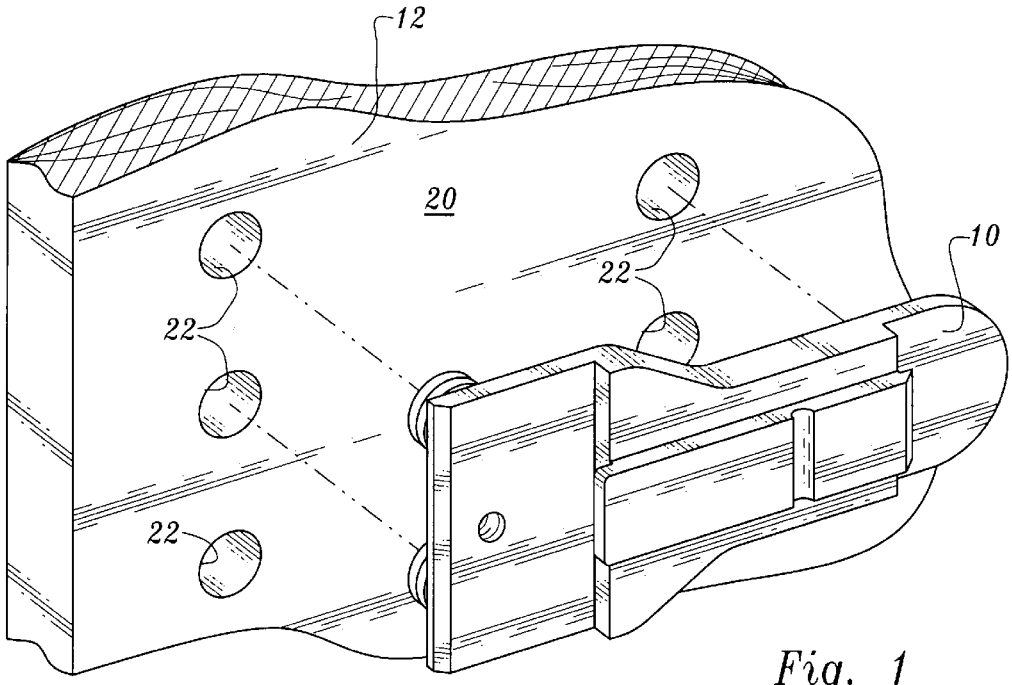
FIG. 1 illustrates a hinge mounting plate just prior to attachment thereof to a cabinet wall, in accordance with the teachings of the present invention.

Referring now to FIGS. 1, 2, 4 and 6, an elongated hinge mounting plate 10 is illustrated. As will be seen below, the mounting plate 10 is for the purpose of mounting a hinge on a cabinet wall, such as cabinet wall 12 shown in the drawings. The mounting plate 10 is part of a hinge member 14 (see FIG. 6) hingedly connected to another hinge member 16 attached to a cabinet door 18. The hinge structure per se is of conventional construction and need not be described in detail. Suffice it to say that the mounting plate 12 cooperates with suitable known mechanism in the rest of hinge member 14 to releasably interconnect these two structural components together, as depicted by the dash line arrows in FIG. 6. An example of such a hinge construction per se is the Grass Snap-On Series 300 hinge made available by Grass America Inc., Kernersville, N.C.

Cabinet wall 12 includes an interior wall surface 20 and has a plurality of holes 22 formed therein. These holes 22 are typical of those found in cabinet walls employing the 32 millimeter system described above. Although only two such rows are shown in FIG. 1, it will be appreciated that the holes 22 extending inwardly from the interior wall surface are arrayed in a plurality of parallel, vertical rows, each vertical row separated a pre-determined distance, center to center, of 32 millimeters from adjacent vertical rows. The holes 22 of each vertical row are spaced from one another a distance less than 32 millimeters.

Figure 4:
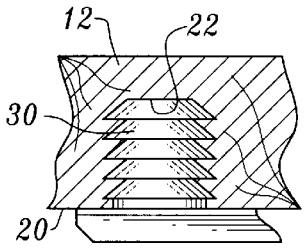
FIG. 4 is a greatly enlarged, cross-sectional view as taken along line 4—4 of FIG. 2 and illustrating one of the fasteners installed in place in a cabinet wall.
Figure 2:
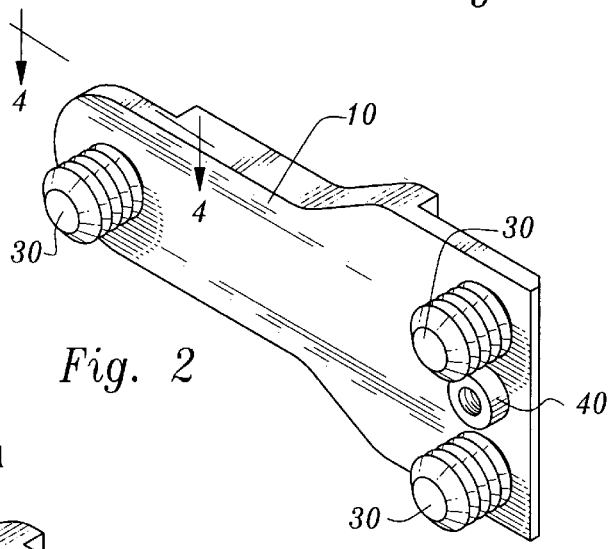
FIG. 2 is a perspective view of the mounting plate and fasteners associated therewith as viewed from the cabinet wall contact side thereof.

Fasteners 30 in the form of knock-in retention dowels project from the inner or cabinet wall engagement surface of the mounting plate 10. These dowels are of conventional construction and are widely widely used in cabinets. A typical dowel diameter size is 10 millimeters. The locations of the dowels are selected to correspond with placement of the holes 22 within which the dowels are to be positioned when applying the plate to the cabinet wall. FIG. 4 illustrates one of the dowels 30 inserted and maintained in place in the cabinet wall.

As indicated above, it is conventional practice to install mounting plates with dowels which occupy the holes of only one vertical row of holes in accordance with the 32 millimeter system. Since the adjacent holes in a row are spaced apart a relatively small distance that is considerably less than 32 millimeters, the leverage or the mechanical advantage provided by such arrangements is relatively low and forces applied to the plates can fairly readily result in failure of thin walled cabinets and pivoting of or separation of the mounting plates.

In contrast, the mounting plate 10 of the present invention is elongated and extends horizontally over two rows of holes 22. In the arrangement shown, two vertically oriented dowels 30 occupy holes in the row of holes located at the left end of the cabinet wall as shown in FIG. 1 while a single dowel 30 occupies a hole 22 of the other illustrated vertical row.

This placement of the dowels enables them to cooperate with the cabinet wall and provide a mechanical advantage to resist pivoting of the hinge member 14 and failure of the cabinet wall when downwardly directed forces are applied to the hinge member 16 by the cabinet door. This arrangement, in effect functions as a lever to resist such pivotal movement. In addition, the load applied to the mounting plate is distributed to three areas of the cabinet wall so that chances of failure of that structure is substantially reduced.

Hinge mounting plate 10 has a boss or protrusion 40 which is internally threaded projecting from the cabinet wall engagement surface, the boss or projection 40 being integral with the elongated hinge mounting plate.

Figure 7:
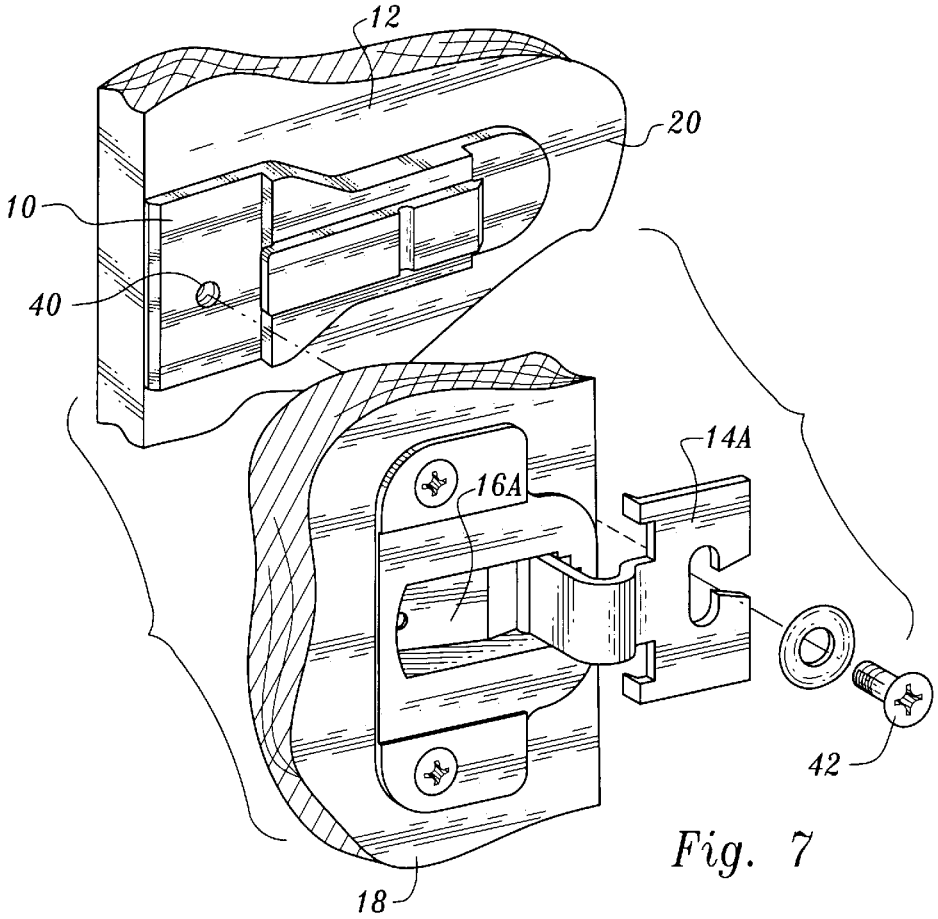
FIG. 7 is a view similar to FIG. 6, but illustrating another form of hinge and fastener.

FIG. 7 shows an alternative form of hinge structure also known in the prior art which can alternatively be used with mounting plate 10. In this arrangement, the mounting plate is connected to the rest of hinge member 14A by means of a threaded fastener 42 threadedly engaged with the internal threads of boss 40.

Figure 3:
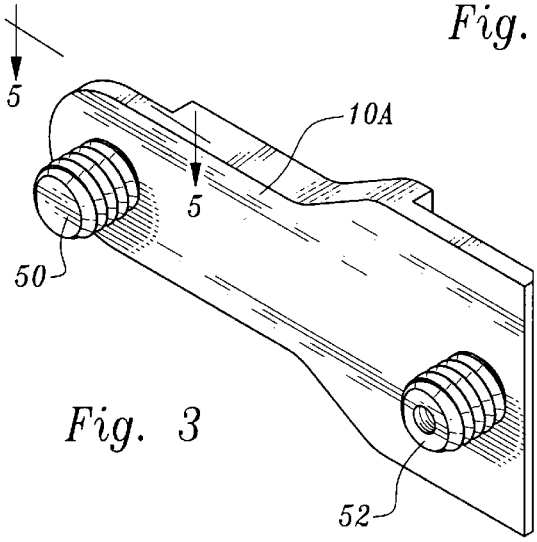
FIG. 3 is a perspective view similar to FIG. 2, but illustrating an alternative form of the invention.
Figure 5:
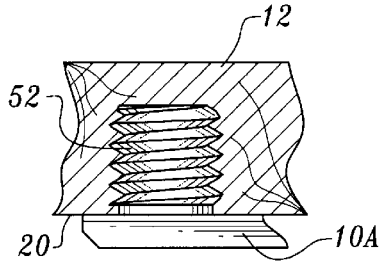
FIG. 5 is a greatly enlarged cross-sectional view illustrating a portion of a cabinet wall with the fastener delineated by line 5—5 in FIG. 3 installed in place.
Figure 6:
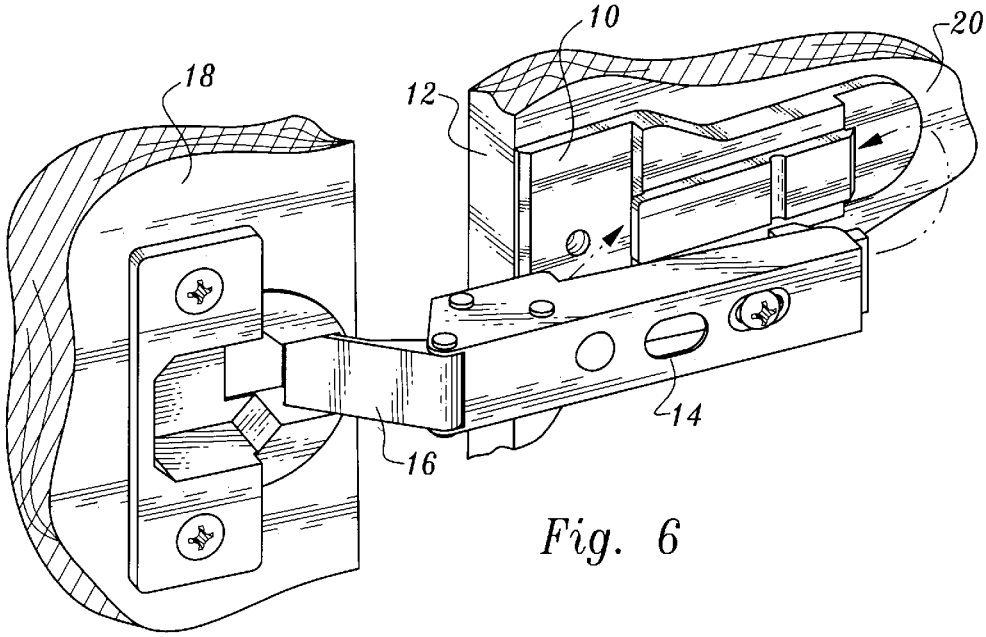
FIG. 6 is a perspective view illustrating a portion of the cabinet wall, a portion of a cabinet door and the mounting plate attached to the cabinet wall having the rest of the hinge attached thereto.

FIGS. 3 and 5 illustrate the use of two fasteners 50, 52 on an elongated hinge mounting plate 10A, one fastener entering a hole 22 of one of the vertical rows and fastener 52 entering the hole 22 of an adjacent row. In this instance, the fasteners or dowels 50, 52 have a spiral shaped outer surface, as compared with the tiered tooth-like outer surface of dowels 30 described above. In addition, the dowel 52 has internal threads. When a bolt such as bolt 42 is screwed into place in dowel 52, the dowel will expand radially to lock it into place in the cabinet wall.

The invention claimed is:

1. In combination:

a cabinet wall including an interior wall surface and having a plurality of holes formed therein extending inwardly into the cabinet wall from said interior wall surface, said holes being arrayed in a plurality of parallel, vertical rows, each vertical row separated a predetermined distance from adjacent vertical rows, and the holes of each vertical row being spaced from one another;

a first hinge member for attachment to a cabinet door;

a second hinge member hingedly connected to said first hinge member, said second hinge member including an elongated hinge mounting plate having a cabinet wall engagement surface and a plurality of spaced fasteners comprising knock-in retention dowels connected to said elongated hinge mounting plate and extending from said cabinet wall engagement surface, said elongated hinge mounting plate extending horizontally between two adjacent vertical rows of holes formed in said cabinet wall with at least one of said fasteners located in a hole of one of said two adjacent vertical rows and at least one of said fasteners located in a hole of the other of said two adjacent vertical rows, said fasteners cooperable with said cabinet wall to resist pivoting of said second hinge member relative to said cabinet wall and failure of the cabinet wall at the hinge location when a downwardly directed force is applied to said first hinge member, an internally threaded boss integral with said elongated hinge mounting plate and projecting from the cabinet wall engagement surface thereof.

* * * * *